US008307742B2

(12) United States Patent
Hsu

(10) Patent No.: US 8,307,742 B2
(45) Date of Patent: Nov. 13, 2012

(54) HAND TOOL ADAPTER

(76) Inventor: Chang Hsueh-O Hsu, Taichung (TW)

( * ) Notice: Subject to any disclaimer, the term of this patent is extended or adjusted under 35 U.S.C. 154(b) by 240 days.

(21) Appl. No.: 12/948,464

(22) Filed: Nov. 17, 2010

(65) Prior Publication Data

US 2011/0179914 A1 Jul. 28, 2011

Related U.S. Application Data

(63) Continuation-in-part of application No. 12/756,864, filed on Apr. 8, 2010, now Pat. No. 8,261,638.

(30) Foreign Application Priority Data

Jan. 26, 2010 (TW) ..... 99102210 A

(51) Int. Cl.
*B25B 13/06* (2006.01)
*B25B 23/16* (2006.01)
*B25G 1/10* (2006.01)

(52) U.S. Cl. ..... 81/124.4; 81/124.3; 81/177.2

(58) Field of Classification Search ..... 81/124.3–124.7, 81/125.1, 177.2, 177.4, 177.5, 3.4, 3.41; 279/143; D8/29
See application file for complete search history.

(56) References Cited

U.S. PATENT DOCUMENTS

| | | | | |
|---|---|---|---|---|
| 226,582 | A * | 4/1880 | Miller | 81/124.4 |
| D53,597 | S * | 7/1919 | Marcmann | D8/28 |
| 1,930,238 | A * | 10/1933 | Heller | 81/124.4 |
| D103,579 | S * | 3/1937 | McNaught | D8/28 |
| 4,056,020 | A * | 11/1977 | Coviello | 81/177.2 |
| 4,727,782 | A * | 3/1988 | Yang | 81/124.4 |
| 6,029,547 | A * | 2/2000 | Eggert et al. | 81/124.6 |
| 6,257,107 | B1 * | 7/2001 | Chang et al. | 81/467 |
| 6,286,395 | B1 * | 9/2001 | Frazier | 81/60 |
| 6,314,841 | B1 * | 11/2001 | Burk et al. | 81/125.1 |
| 6,382,054 | B1 | 5/2002 | Kirk | |
| 6,408,723 | B1 * | 6/2002 | Zurbuchen | 81/119 |
| 6,962,098 | B2 * | 11/2005 | Eggert et al. | 81/124.6 |
| 7,305,907 | B2 * | 12/2007 | Burwell | 81/60 |
| 2002/0011136 | A1 * | 1/2002 | Eggert et al. | 81/125.1 |
| 2004/0099102 | A1 * | 5/2004 | Vaughan | 81/124.4 |
| 2004/0177733 | A1 * | 9/2004 | Peters | 81/490 |
| 2005/0261784 | A1 * | 11/2005 | Erb | 623/65 |
| 2010/0011915 | A1 * | 1/2010 | Badger | 81/60 |

FOREIGN PATENT DOCUMENTS

| | | |
|---|---|---|
| TW | 437519 | 5/2001 |
| TW | M257924 | 3/2005 |
| TW | M361408 | 7/2009 |

* cited by examiner

*Primary Examiner* — David B Thomas
(74) *Attorney, Agent, or Firm* — Muncy, Geissler, Olds & Lowe, PLLC

(57) ABSTRACT

A hand tool adapter of the present invention includes a wheel shaped main body and at least four sockets. The main body has a top surface, a bottom surface and a peripheral surface. The sockets are firmly disposed in the main body, locating annularly on the peripheral surface. Each socket has a non-circular bore. The main body is formed with no hole which has a dimension larger than the dimension of the largest bore. As such, the structure of the adapter is strengthened.

14 Claims, 3 Drawing Sheets

HAND TOOL ADAPTER

The application is a Continuation-In-Part of prior application Ser. No. 12/756,864 filed Apr. 8, 2010, now U.S. Pat. No. 8,261,638, the entire contents of which are hereby incorporated by reference.

BACKGROUND OF THE INVENTION

1. Field of the Invention
2. Description of the Prior Art

As disclosed in TW M257924 and TW 437519, a conventional hand tool can drive a screw or a nut to rotate for fastening purposes. Another hand tool as disclosed in TW M361408 provides a ratchet mechanism whose axis can be adjusted. However, the driving portion thereof has fixed dimension. Thus it requires several hand tools in order to drive workpieces with different dimensions. Accordingly, adapters are arisen to mitigate such disadvantages. Nevertheless, it still requires several adapters in order to correspond to workpieces with different dimensions.

To fit with workpieces with different dimensions, U.S. Pat. No. 6,382,054 discloses a wrench. However, the wrench meets some problems in durability and practicability. As the openings are formed larger in size, the thickness of the wrench between two adjacent openings is going smaller. As a result, the mechanical strength of the wrench is weakened. Besides, the openings penetrate from flat surfaces to the cylindrical opening. When the wrench is put on a nut, the nut will probably fall into the cylindrical opening.

SUMMARY OF THE INVENTION

The main object of the present invention is to provide a durable and practical adapter which can correspond to workpieces with different dimensions.

To achieve the above and other objects, a hand tool adapter of the present invention includes a wheel shaped main body and at least four sockets.

The main body has a top surface, a bottom surface and a peripheral surface.

Each socket is firmly disposed in the main body. The sockets are annularly located on the peripheral surface. Each socket defines a non-circular bore. Each non-circular bore has an axial vector. The axial vectors of the non-circular bores are different from one another. Each non-circular bore has a dimension different from those of the other non-circular bores.

In some cases, a through hole is defined by the main body. The through hole penetrates from the top surface to the bottom surface. A dimension of the through hole is not larger than that of the non-circular bore whose dimension is larger than those of the other non-circle bores.

In some cases, the top surface and the bottom surface are solid surfaces.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
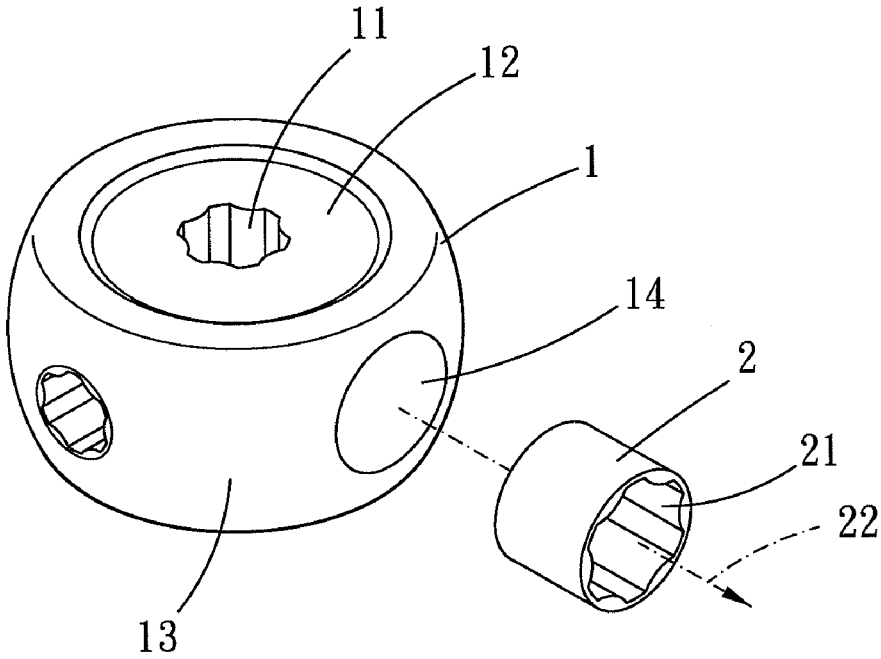
FIG. 1 is a breakdown drawing showing an adapter of the present invention.
Figure 2:
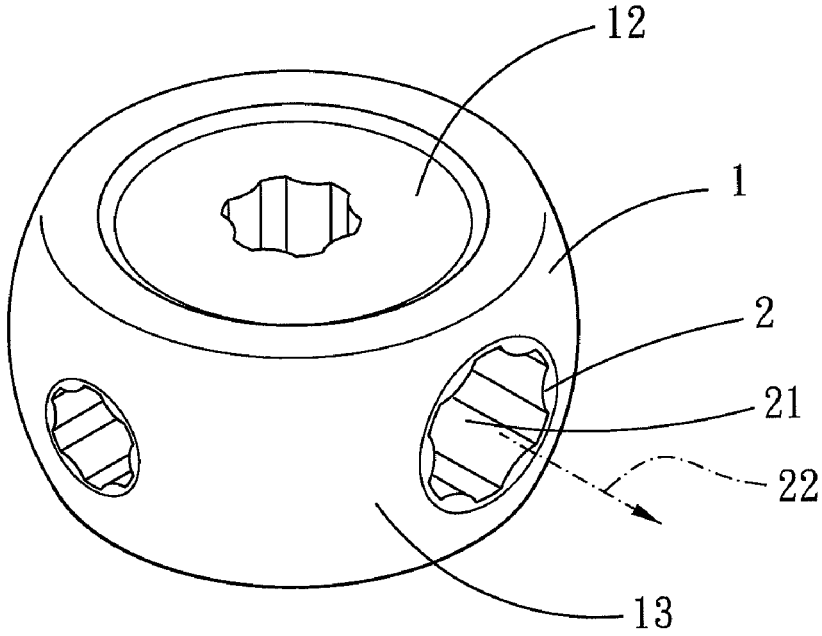
FIG. 2 is a perspective drawing showing an adapter of the present invention.

Please refer to FIG. 1 and FIG. 2. A hand tool adapter of the present invention includes a main body 1 and four or more than four sockets 2.

The main body 1 is partially or totally made from plastic or from other nonmetallic material so as to reduce the weight of the hand tool adapter. Preferably, the main body 1 is made from glass-fiber-reinforced plastic. The main body 1 is wheel-shaped, so the main body has a top surface 12, a bottom surface and a peripheral surface 13 between the top surface 12 and the bottom surface. A through hole 11 is defined by the main body. The through hole 11 penetrates from the top surface 12 to the bottom surface. Preferably, the through hole 11 has a non-circular cross section. Further, the main body 1 may be formed with four or more than four holes 14. The holes are annularly located on the peripheral surface 12. The cross sections of the holes 14 may be rounded or non-circular, e.g. hexagonal. The peripheral surface 12 has a circular contour. In other possible embodiments of the present invention, the periphery surface 12 may have a polygonal contour.

The sockets 2 may be made from metallic material to obtain better mechanical strength. Each socket 2 has a contour corresponding to the cross section of its corresponding hole 14 so that the socket 2 can be fixedly received therein. Each socket 2 defines a non-circular bore 21, which has an axial vector 22 going from the inside of the main body 1 toward the outside of the main body 1. The axial vectors 22 of the bores 21 are different from one another. Furthermore, each bore 21 has a dimension different from those of the other bores 21. A dimension of the through hole 11 is not larger than that of the bore 21 whose dimension is larger than those of the other non-circle bores. In other words, at least one of the bores 21 has a dimension equal to or larger than the dimension of the through hole 11. In the present embodiment, every two opposite bores 21 are coaxial.

Accordingly, the adapter can be directly used to drive a screw or the like. More specifically, the screw is engaged with one of the sockets. Users can grab and turn the adapter in one hand so as to tighten or loosen the screw. In addition, a rod can be used to insert through the through hole 11. Users can drive the adapter to rotate with the rod.

According to the embodiments above, the dimension of the through hole 11 is not larger than the dimension of at least one of the bores 21. The top surface and the bottom surface are capable to support whole structure of the adapter. As such, mechanical strength of the adapter is strengthened.

In other possible embodiments of the present invention, the sockets and the through hole may be formed on one metal slug to obtain greater mechanical strength. Furthermore, the metal slug is partially covered by nonmetallic material so as to produce the adapter. In other words, the main body may be made from the metal slug and nonmetallic material. In manufacturing, nonmetallic material can be fixed on the metal slug by injection molding, by bonding, by fusing or by fabricating.

Figure 3:
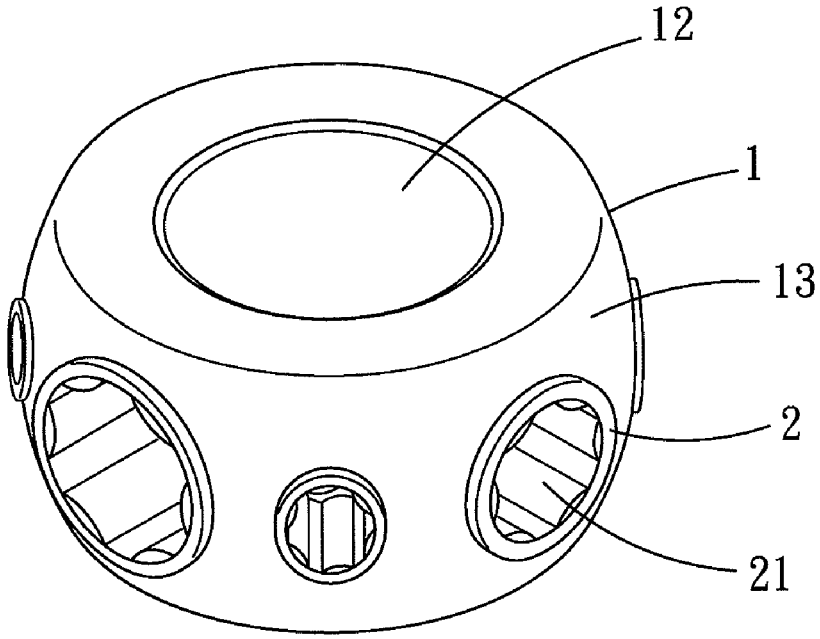
FIG. 3 is a perspective drawing showing another adapter of the present invention.
Figure 4:
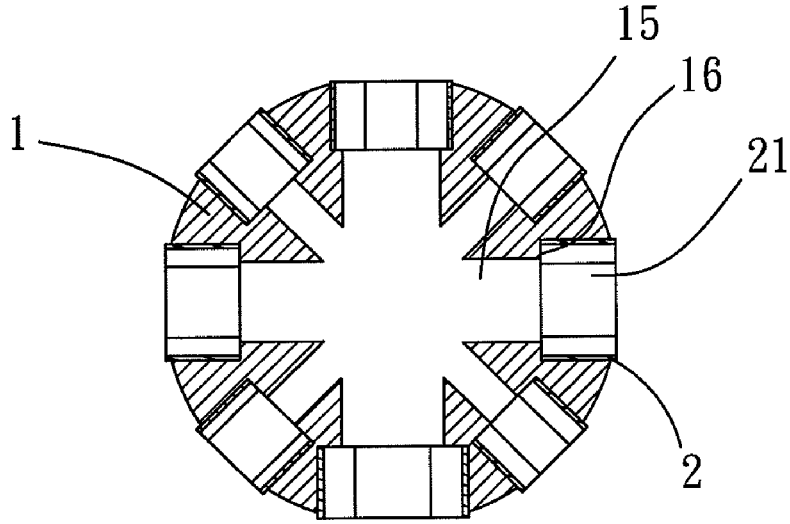
FIG. 4 is a profile showing another adapter of the present invention.
Figure 5:
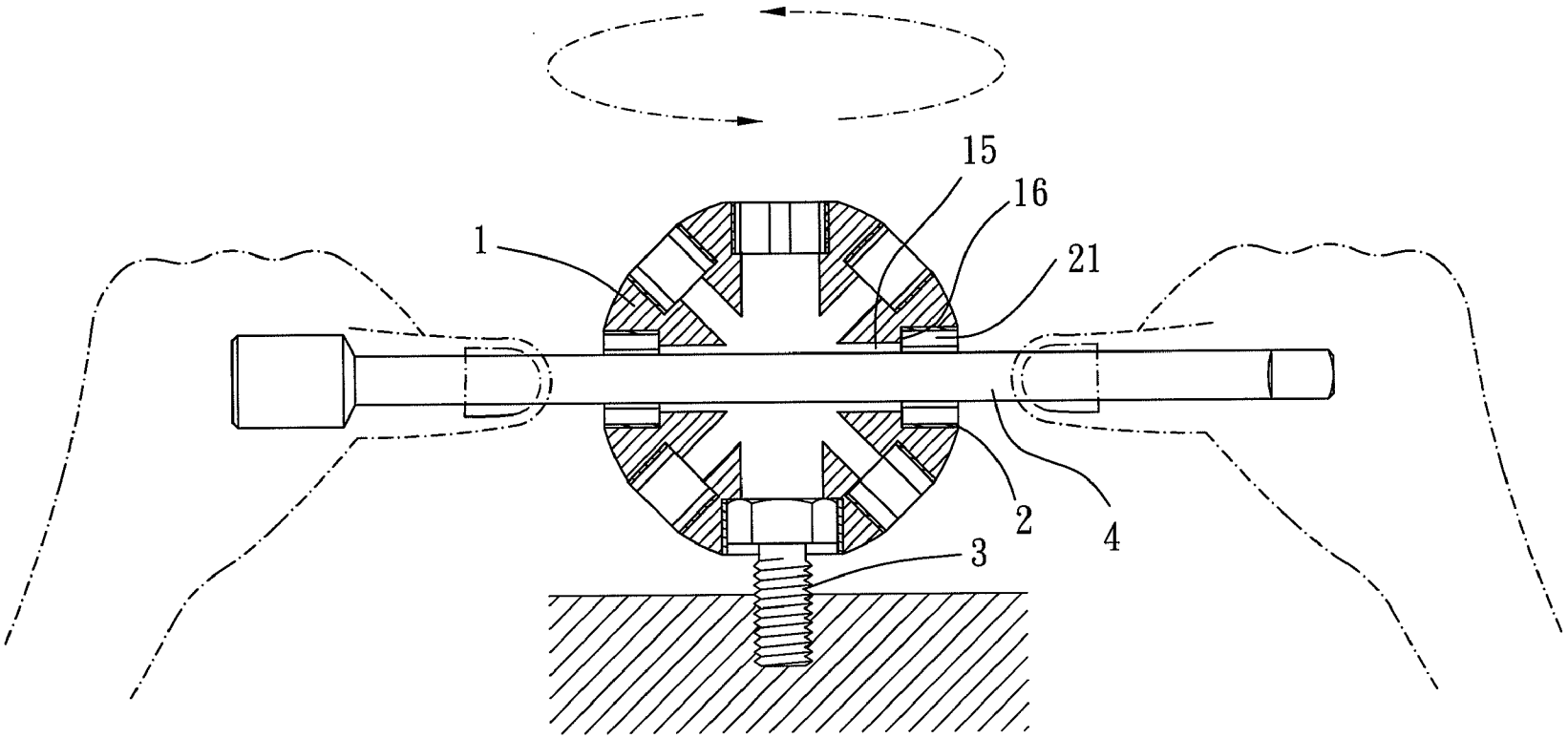
FIG. 5 is a drawing showing a user using an adapter of the present invention.

Please refer to FIG. 3 to FIG. 5. In another embodiment of the present invention, the adapter has eight sockets 2. The top surface 12 and the bottom surface are solid surfaces. Solid surface is a substantial surface which is formed with no hole.

As such, mechanical strength of the adapter is further strengthened. The main body 1 may have one or more connecting hole(s) 15 communicating with two opposite coaxial bores 21. Further, the connecting hole 15 may have a non-circular cross section. Preferably, a dimension of the connecting hole 15 is smaller than those of the bores 21 of the sockets, so that two step portions 16 are formed between the connecting hole 15 and the two bores 21. As such, the workpiece 3 received in the bore 21 will not fall into the adapter, more specifically into the connecting hole 15. Though the main body may have no through hole on the top surface and the bottom surface, a rod 4 can be used to insert through the connecting hole 15 and to drive the main body 1 to rotate. It is noted that the adapter of the present invention has several sockets 2 for users to choose from, so as to correspond to workpieces with different dimensions. Further, the user can use the adapter to drive the workpiece bare-handedly or with the help of a rod, as disclosed hereinabove.

What is claimed is:

1. A hand tool adapter, comprising:

a wheel shaped main body, having a top surface, a bottom surface and a peripheral surface, a through hole being defined by the main body, the through hole penetrating from the top surface to the bottom surface;

at least four sockets, each of which is firmly disposed in the main body, the sockets being annularly located on the peripheral surface, each socket defining a non-circular bore, each non-circular bore having an axial vector, the axial vectors of the non-circular bores being different from one another, each non-circular bore having a dimension different from those of the other non-circular bores;

wherein a dimension of the through hole is not larger than that of the non-circular bore whose dimension is larger than those of the other non-circle bores.

2. The adapter of claim 1, wherein the sockets are formed on a metal slug, the through hole is formed on the metal slug, the metal slug is partially covered by nonmetallic material so as to produce the adapter.

3. The adapter of claim 1, wherein the main body is partially made from glass-fiber-reinforced plastic, the sockets are made form metallic material.

4. The adapter of claim 1, wherein every two opposite non-circular bores are coaxial.

5. The adapter of claim 4, wherein the main body has at least one connecting hole communicating with two opposite non-circular bores.

6. The adapter of claim 5, wherein a dimension of the connecting hole is smaller than those of the opposite non-circular bores.

7. The adapter of claim 1, wherein the peripheral surface has a circular contour.

8. A hand tool adapter, comprising:

a wheel shaped main body, having a solid top surface, a solid bottom surface and a peripheral surface;

at least four sockets, each of which is firmly disposed in the main body, the sockets being annularly located on the peripheral surface, each socket defining a non-circular bore, each non-circular bore having an axial vector, the axial vectors of the non-circular bores being different from one another, each non-circular bore having a dimension different from those of the other non-circular bores.

9. The adapter of claim 8, wherein the sockets are formed on a metal slug, the metal slug is partially covered by non-metallic material so as to produce the adapter.

10. The adapter of claim 8, wherein the main body is partially made from glass-fiber-reinforced plastic, the sockets are made form metal.

11. The adapter of claim 8, wherein every two opposite non-circular bores are coaxial.

12. The adapter of claim 11, wherein the main body has at least one connecting hole communicating with two opposite non-circular bores.

13. The adapter of claim 12, wherein a dimension of the connecting hole is smaller than those of the opposite non-circular bores.

14. The adapter of claim 8, wherein the peripheral surface has a circular contour.

* * * * *